US006401373B1

(12) United States Patent
Sexton

(10) Patent No.: US 6,401,373 B1
(45) Date of Patent: Jun. 11, 2002

(54) ILLUMINATED ADDRESS DISPLAY

(76) Inventor: Clifford E. Sexton, 712 Eleventh Ave., Rock Falls, IL (US) 61071

( * ) Notice: Subject to any disclaimer, the term of this patent is extended or adjusted under 35 U.S.C. 154(b) by 0 days.

(21) Appl. No.: 09/598,720

(22) Filed: Jun. 21, 2000

(51) Int. Cl.[7] ..... B09F 13/06
(52) U.S. Cl. ..... 40/576; 40/600; 40/621
(58) Field of Search ..... 40/564, 576, 581, 40/580, 600, 621

(56) References Cited

U.S. PATENT DOCUMENTS

| | | | | | |
|---|---|---|---|---|---|
| 2,878,606 | A | * | 3/1959 | Meijer | 40/576 X |
| 3,444,638 | A | * | 5/1969 | Jahn | 40/600 X |
| 3,968,584 | A | | 7/1976 | Kingston | |
| 4,229,894 | A | | 10/1980 | Beck | |
| 4,387,522 | A | * | 6/1983 | Sommers-Szoszky | 40/576 |
| 4,587,753 | A | * | 5/1986 | Harper | 40/580 X |
| 4,765,080 | A | * | 8/1988 | Conti | 40/576 |
| 4,807,378 | A | * | 2/1989 | Bell | 40/576 |
| 4,848,017 | A | | 7/1989 | Bailey et al. | |
| 4,901,461 | A | | 2/1990 | Edwards et al. | |
| 4,937,499 | A | | 6/1990 | Hunte | |
| 5,573,328 | A | | 11/1996 | Hwang | |
| 5,649,378 | A | | 7/1997 | Roesser, Jr. et al. | |
| 5,832,642 | A | | 11/1998 | Dalton | |
| 5,890,306 | A | | 4/1999 | Smith | |
| 5,911,524 | A | | 6/1999 | Wilton | |

* cited by examiner

*Primary Examiner*—Joseph D. Pape
*Assistant Examiner*—Jason Morrow
(74) *Attorney, Agent, or Firm*—Dale J. Ream

(57) ABSTRACT

An illuminated address display comprises a generally rectangular light housing defining an interior space and an open front. A light source coupled to a power source is positioned within the interior space of the light housing so as to project light forwardly therefrom through the open front. A pair of spaced apart metallic members extend longitudinally between side panels of the light housing and are positioned adjacent top and bottom panels thereof. The address display further includes a plurality of character plates, each plate having a cutout in the shape of an alphanumeric character or artistic design. Each plate further includes a pair of spaced apart magnetic elements for removably adhering to respective metallic members, whereby an address may be formed and displayed as light from the light source passes through the cutouts of selectively positioned character plates.

1 Claim, 4 Drawing Sheets

ILLUMINATED ADDRESS DISPLAY

BACKGROUND OF THE INVENTION

This invention relates generally to illuminated display fixtures and, more particularly, to an illuminated address display having character plates which magnetically adhere to a light housing and through which delectably colored light may project.

Numerous address display fixtures have been proposed in the prior art for illuminating the address numerals of a residence for enhanced identification purposes at night. While assumably effective for their intended purposes, the existing address display fixtures do not provide a user with the convenient ability to change the displayed address or to change other ornamental display components. In addition, existing devices do not provide a user with the option of selecting the color of light to be projected through the address numerals or characters.

Therefore, it is desirable to have an illuminated address display which allows selected character plates to be selectively magnetically attached or removed from the display device. Further, it is desirable to have an illuminated display in which lights having different colors may be selectably projected through selected character plates.

SUMMARY OF THE INVENTION

An illuminated address display according to the preferred embodiment of the present invention includes a generally rectangular light housing having a back panel, a top panel, a bottom panel, and first and second opposed side panels, The light housing defines an interior space and an open front. A light source which includes two bulbs of different colors is mounted to the back panel within the interior space and is positioned so as to direct light from the bulbs forwardly through the open front when the light source is energized. The light source is electrically connected to a power source. The display includes a switch for selecting which bulb to energize. Preferably, the two bulbs are red and white, respectively, such that the white bulb may be used to assist guests or delivery persons in locating a residence at night whereas the red light may be energized to alert passersby or medical personnel of an emergency medical situation. The illuminated address display may also include a light activated switch which causes the white light to be energized automatically at dusk and de-energized at dawn. The red light is activated or deactivated manually.

The top and bottom panels of the light housing extend forwardly beyond the front edge of the first side panel such that selected ones of a plurality of character plates may be slidably inserted therebetween. A pair of metallic members extend between the side panels and are positioned within the interior space flush with the front edge of the first side panel 20. The back side of each character plate includes a pair of magnetic strips adjacent top and bottom edges thereof such that each character plate may be removably adhered to the metallic members. Each character plate further includes a cutout in the shape of a respective alphanumeric character or ornamental design. Therefore, desired numerals, letters, or design plates may be magnetically adhered to the metallic members of the light housing. When energized, the desired color of light is projected through the cutouts to illuminate the address.

Therefore, a general object of this invention is to provide an illuminated address display for enhancing the ability of a person to identify a residential or business address at night.

Another object of this invention is to provide an illuminated address display, as aforesaid, having magnetic character plates that are convenient to attach to or remove from the display.

Still another object of this invention is to provide an illuminated address display, as aforesaid, which includes a light source having two differently colored light bulbs for selectively projecting different colors of light through the character plates.

Yet another object of this invention is to provide an illuminated address display, as aforesaid, that is simple to use and economical to manufacture.

A further object of this invention is to provide an illuminated address display, as aforesaid, having a transparent plate extending between the metallic members for preventing insects or dirt from entering the interior space and for permitting light to project through the character plates.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
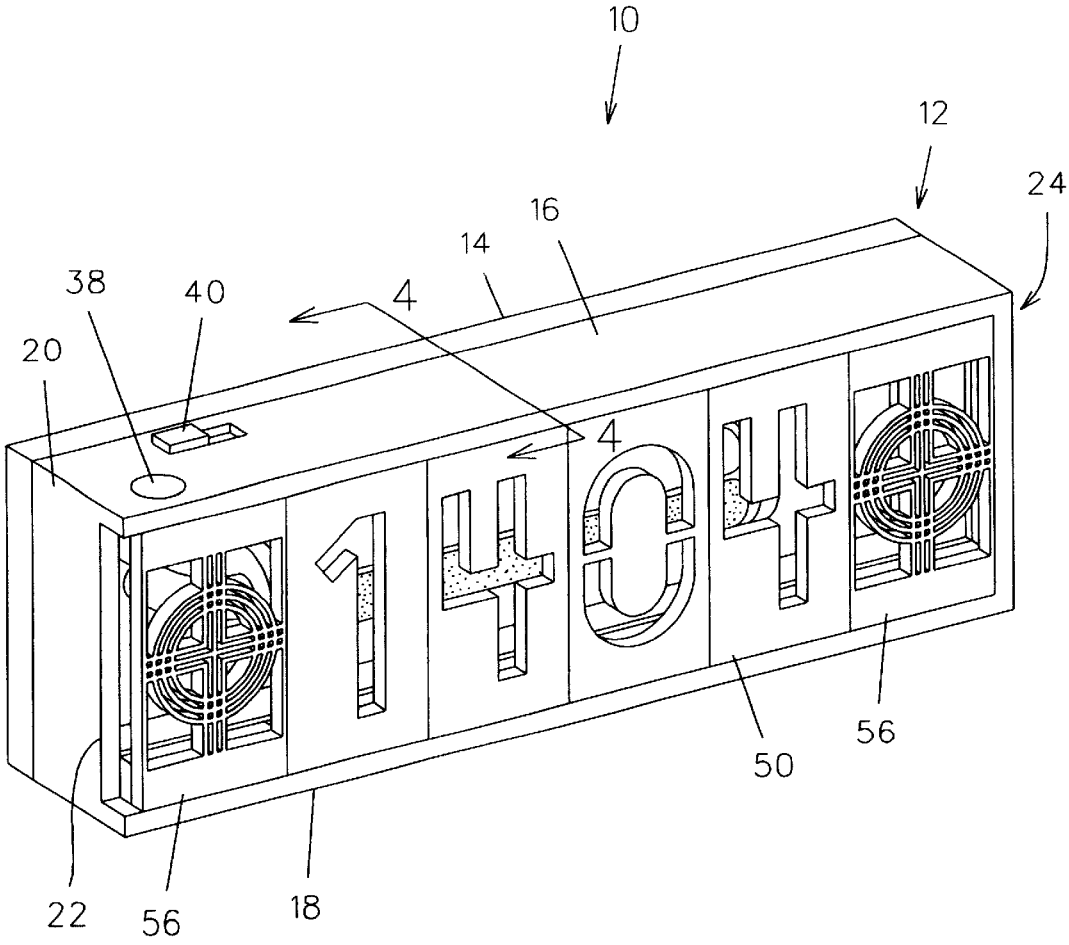
FIG. 1 is a perspective view of an illuminated address display according to a preferred embodiment of the present invention.
Figure 2:
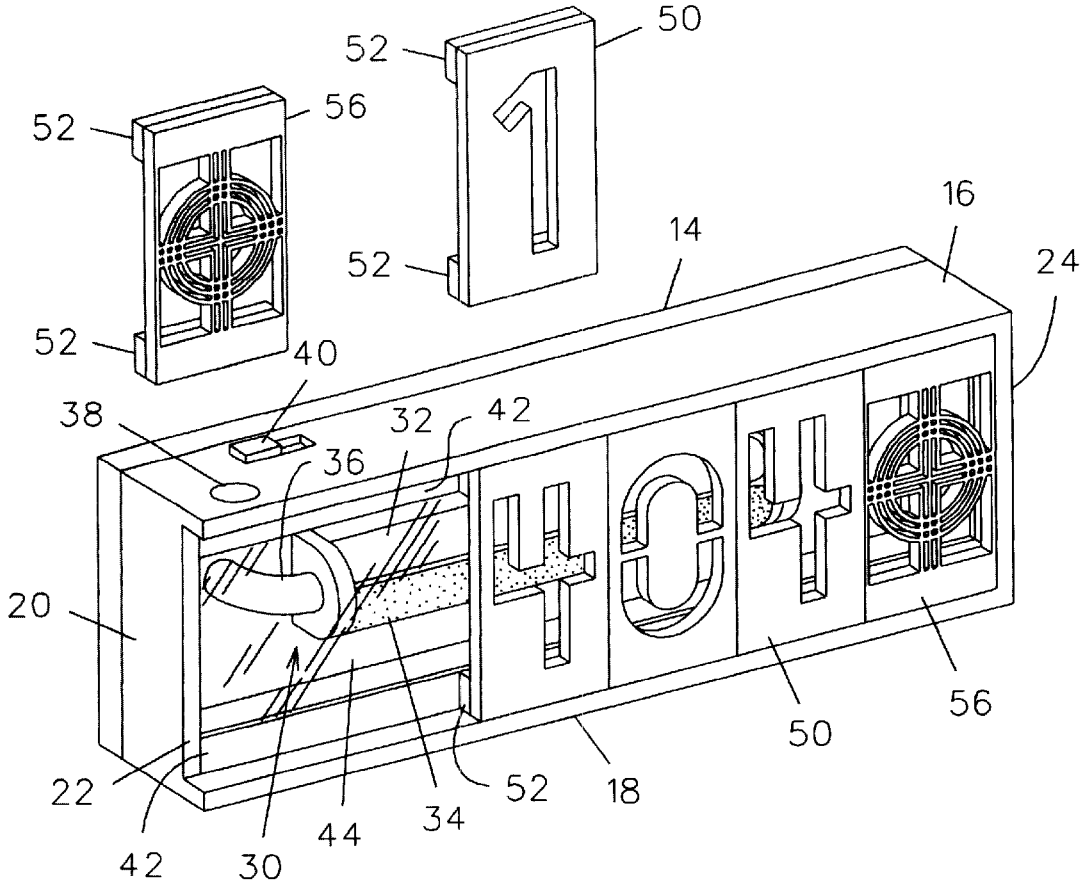
FIG. 2 is a perspective view of the illuminated address display as in FIG. 1 with an ornamental plate and character plate removed.
Figure 3:
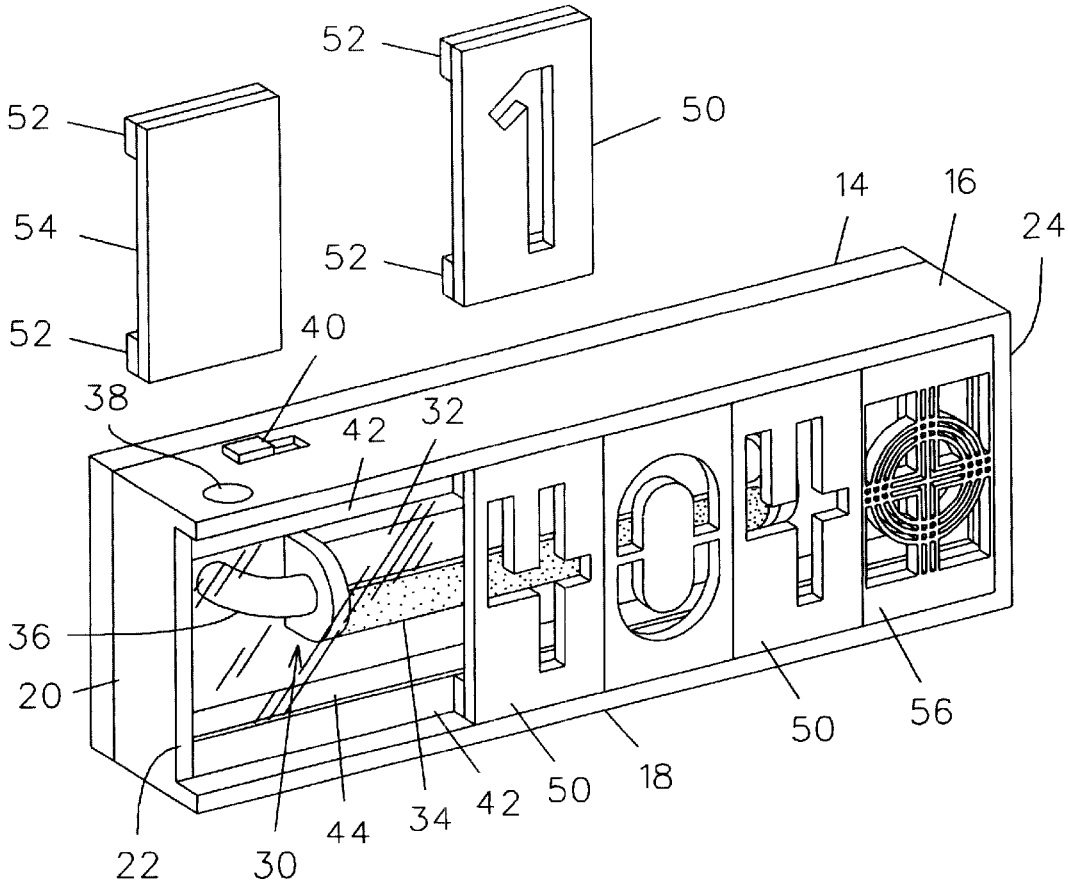
FIG. 3 is a perspective view of the illuminated address display as in FIG. 1 with a spacer plate and character plate removed.

An illuminated address display 10 according to a preferred embodiment of the present invention will now be described with reference to FIGS. 1–4 of the accompanying drawings. The address display 10 includes a generally rectangular box-like light housing 12 having a back panel 14, top panel 16, bottom panel 18, and first 20 and second 24 side panels. The light housing 12, therefore, defines an interior space and an open front (FIGS. 2 and 3). The back panel 14 is coupled to the side panels 20, 24 with mounting screws 26 or other similar fasteners.

Figure 4:
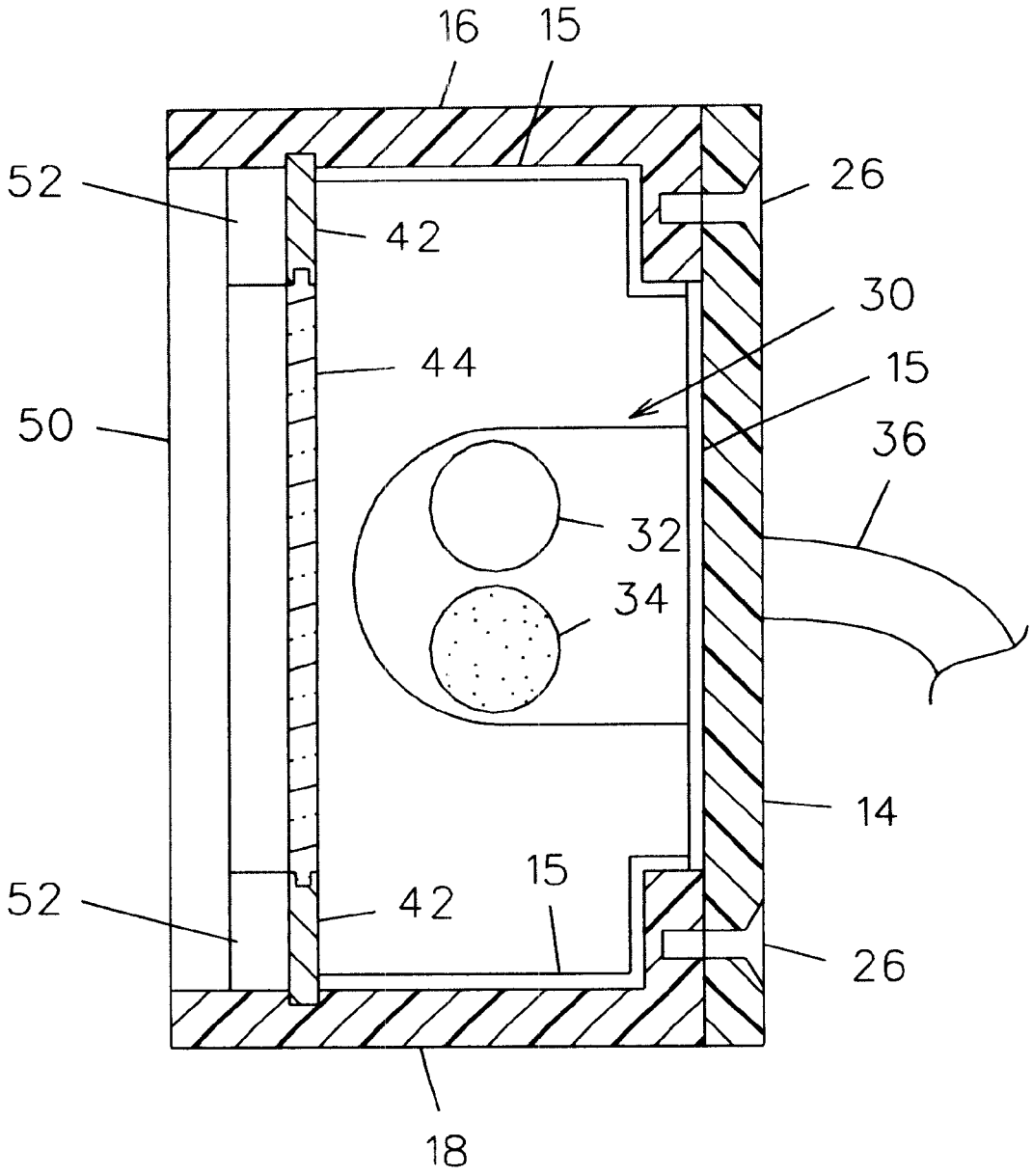
FIG. 4 is a sectional view of the illuminated address display taken along line 4—4 of FIG. 1.

A light source 30 is mounted to the back panel 14 within the interior space and includes at least two light bulbs 32, 34, each bulb projecting light of a color different from the other when energized. Preferably, the bulbs 32, 34 are white and red, respectively, the white light being used to assist guests or delivery persons in locating the residence at night and the red light being used to alert passersby or emergency personnel of an emergency medical situation. The light source 30 is electrically connected to a conventional AC electrical power source with a power cord 36, although battery or solar power would also be suitable. The light source 30 is mounted such that light is projected forwardly through the open front of the light housing 12. The back panel 14 and side panels 20, 24 may be covered with a reflective material 15 so as to further enhance forward light projection (FIG. 4). The address display 10 further includes a light activated switch having a light sensor 38 mounted on the top panel 16 of the housing 12. The light sensor 38 is electrically coupled to the light source 30 for automatically energizing or de-energizing the white light bulb according to the sufficiency of ambient light. A manual activation switch 40 is also included for activating a selected light bulb. It is understood that the switch 40 may also include a setting for causing the white bulb to flash to further aid a delivery person in locating the residence.

A front edge 22 of the first side panel 20 is recessed from front edges of the top 16 and bottom 18 panels. Thus, the top and bottom panels extend beyond the front edge 22 of the first side panel 20 so that character plates 50 may be slidably inserted between the top and bottom panels, as to be described more fully below. A pair of elongate metallic members 42 are fixedly attached to the top 16 and bottom 18 panels within the interior space of the housing 12 and extend longitudinally between the first 20 and second 24 side panels. The metallic members 42 are positioned flush with the front edge 22 of the first side panel 20 and extend parallel to the front edges of the top 16 and bottom 18 panels. Each metallic member defines only a small height dimension such that the open front of the light housing 12 remains substantially open for light projection therethrough.

A transparent plate 44, constructed of glass, clear plastic, or the like, is positioned within the interior space of the housing 12 (FIGS. 2 and 3). The plate 44 extends vertically between the metallic members 42 and longitudinally between the side panels 20, 22 so as to completely seal the light source 30 from dirt or insect accumulation. Alternatively, the plate 44 may be constructed of a translucent material.

The illuminated address display 10 further includes a plurality of character plates 50. Each character plate 50 includes a cutout in the shape of a numeral or letter. At least one solid plate 54 having no cutout is also included for use as a spacer, if desired (FIG. 3). Plates 56 having artistic design cutouts are also included to enhance the aesthetic appeal of the address display 10 (FIG. 2). A pair of magnetic elements 52, such as strip magnets, are fixedly attached to the rear surface of each plate adjacent top and bottom edges thereof such that selected plates adhere to the metallic members 42 when positioned between the top 16 and bottom 18 panels of the housing 12.

In use, the light housing 12 may be mounted to the front of a residence or remotely therefrom such as at the end of a driveway, as desired. The light source 30 may then be coupled to an electrical power source in a conventional manner. Selected character plates 50 may be positioned between the top 16 and bottom 18 panels such that the magnetic elements 52 of each plate are magnetically adhered to the metallic members 42 within the interior space of the housing 12. Spacer plates 54 or artistic design plates 56 may likewise be positioned between the top 16 and bottom 18 panels until the open front is completely enclosed. Plates may be easily removed and replaced by sliding the plates through the recessed front edge 22 of the first side panel 20.

When energized, light from the light source 30 is projected through the cutouts of the plates so as to illuminate the address and design. The manual switch 40 may be toggled to select the desired light bulb to be activated. The white light bulb 32 is further controlled by the light sensitive sensor 38, the sensor causing the white bulb to be energized at dusk and de-energized at dawn.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. An illuminated address display, comprising:

a generally rectangular light housing having a back panel, a top panel, a bottom panel, and first and second side panels, said housing defining an open front and an interior space;

a power source;

a light source electrically coupled to said power source and positioned in said interior space so as to project light forwardly through said open front, said light source including at least two light bulbs, each light bulb having a different color;

a reflective material covering said back, first, and second side panels for reflecting light projected from said light source and enhancing the forward projection of light therefrom;

a switch electrically connected to said power source and to said at least two light bulbs, said switch adapted to selectively energize a respective one of said at least two light bulbs of said light source, said switch adapted to selectively intermittently energize said respective one of said at least two light bulbs of said light source;

a pair of spaced apart metallic members extending longitudinally between said first and second side panels;

a plurality of character plates, each character plate having a cutout in the shape of a respective alphanumeric character and having a pair of spaced apart magnetic elements attached to one side thereof for adhering to said pair of metallic members, whereby each said character plate is adapted to be removably attached to said metallic members and light from said light source passes through said cutouts when said light source is energized;

wherein a front edge of said first side panel is recessed from front edges of said top and bottom panels such that said character plates are slidably received therebetween, said pair of metallic members positioned on said top and bottom panels between said first and second side panels, whereby said magnetic elements adhere to said metallic members when said character plates are positioned between said top and bottom panels;

a transparent plate mounted between said metallic members and extending longitudinally between said first and second side panels; and a light sensor mounted on said top panel and electrically connected to said light source for automatically energizing or de-energizing a predetermined light bulb of said light source according to a sensed level of ambient light.

* * * * *